US008875413B2

(12) United States Patent
Ling

(10) Patent No.: US 8,875,413 B2
(45) **Date of Patent: *Nov. 4, 2014**

(54) CONTROLLED NUCLEATION DURING FREEZING STEP OF FREEZE DRYING CYCLE USING PRESSURE DIFFERENTIAL ICE CRYSTALS DISTRIBUTION FROM CONDENSED FROST

(75) Inventor: Weijia Ling, Highland, NY (US)

(73) Assignee: Millrock Technology, Inc., Kingston, NY (US)

( * ) Notice: Subject to any disclaimer, the term of this patent is extended or adjusted under 35 U.S.C. 154(b) by 253 days.

This patent is subject to a terminal disclaimer.

(21) Appl. No.: 13/572,978

(22) Filed: Aug. 13, 2012

(65) Prior Publication Data

US 2014/0041250 A1 Feb. 13, 2014

(51) Int. Cl.
*F26B 5/06* (2006.01)

(52) U.S. Cl.
USPC ..... 34/298; 34/403; 34/407

(58) Field of Classification Search
USPC ..... 34/284, 292, 293, 296, 298, 301, 402, 34/403, 406, 407, 559
See application file for complete search history.

(56) References Cited

U.S. PATENT DOCUMENTS

| | | | | |
|---|---|---|---|---|
| 4,350,568 | A * | 9/1982 | Dalupan | 202/180 |
| 6,630,185 | B2 | 10/2003 | Arends et al. | |
| 7,299,655 | B2 * | 11/2007 | Ward | 62/614 |
| 2007/0186567 | A1 | 8/2007 | Gasteyer et al. | |
| 2012/0272544 | A1 * | 11/2012 | Ling | 34/298 |

OTHER PUBLICATIONS

Patel, S. M., et al., "*Reduced Pressure Ice Fog Technique for Controlled Ice Nucleation during Freeze-Drying*," AAPS Pharm. Sci. Tech., vol. 10, No. 4, Dec. 2009, pp. 1406-1411.
Passot, S., et al., "*Effect of Controlled Ice Nucleation on Primary Drying Stage and Protein Recovery in Vials Cooled in a Modified Freeze-Dryer*," Journal of Biomechanical Engineering, vol. 131, Jul. 2009, pp. 074511-1 to 074511-5.

* cited by examiner

*Primary Examiner* — Jiping Lu
(74) *Attorney, Agent, or Firm* — Nixon & Vanderhye, PC

(57) ABSTRACT

A method of controlling and enhancing the nucleation of product in a freeze dryer, wherein the product is maintained at a predetermined temperature and pressure in a chamber of the freeze dryer, and a predetermined volume of condensed frost is created on an inner surface of a condenser chamber separate from the product chamber and connected thereto by a vapor port. The condenser chamber has a predetermined pressure that is greater than that of the product chamber. The opening of the vapor port into the product chamber creates gas turbulence that breaks down the condensed frost into ice crystals that rapidly enter the product chamber for even distribution therein to create uniform and rapid nucleation of the product in different areas of the product chamber.

11 Claims, 2 Drawing Sheets

CONTROLLED NUCLEATION DURING FREEZING STEP OF FREEZE DRYING CYCLE USING PRESSURE DIFFERENTIAL ICE CRYSTALS DISTRIBUTION FROM CONDENSED FROST

BACKGROUND OF THE INVENTION

1. Field of the Invention

The present invention relates to a method of controlling nucleation during the freezing step of a freeze drying cycle and, more particularity, to such a method that uses a pressure differential ice fog distribution to trigger a spontaneous nucleation among all vials in a freeze drying apparatus at a predetermined nucleation temperature.

2. Description of the Background Art

Controlling the generally random process of nucleation in the freezing stage of a lyophilization or freeze-drying process to both decrease processing time necessary to complete freeze-drying and to increase the product uniformity from vial-to-vial in the finished product would be highly desirable in the art. In a typical pharmaceutical freeze-drying process, multiple vials containing a common aqueous solution are placed on shelves that are cooled, generally at a controlled rate, to low temperatures. The aqueous solution in each vial is cooled below the thermodynamic freezing temperature of the solution and remains in a sub-cooled metastable liquid state until nucleation occurs.

The range of nucleation temperatures across the vials is distributed randomly between a temperature near the thermodynamic freezing temperature and some value significantly (e.g., up to about 30° C.) lower than the thermodynamic freezing temperature. This distribution of nucleation temperatures causes vial-to-vial variation in ice crystal structure and ultimately the physical properties of the lyophilized product. Furthermore, the drying stage of the freeze-drying process must be excessively long to accommodate the range of ice crystal sizes and structures produced by the natural stochastic nucleation phenomenon.

Nucleation is the onset of a phase transition in a small region of a material. For example, the phase transition can be the formation of a crystal from a liquid. The crystallization process (i.e., formation of solid crystals from a solution) often associated with freezing of a solution starts with a nucleation event followed by crystal growth.

Ice crystals can themselves act as nucleating agents for ice formation in sub-cooled aqueous solutions. In the known "ice fog" method, a humid freeze-dryer is filled with a cold gas to produce a vapor suspension of small ice particles. The ice particles are transported into the vials and initiate nucleation when they contact the fluid interface.

The currently used "ice fog" methods do not control the nucleation of multiple vials simultaneously at a controlled time and temperature. In other words, the nucleation event does not occur concurrently or instantaneously within all vials upon introduction of the cold vapor into the freeze-dryer. The ice crystals will take some time to work their way into each of the vials to initiate nucleation, and transport times are likely to be different for vials in different locations within the freeze-dryer. For large scale industrial freeze-dryers, implementation of the "ice fog" method would require system design changes as internal convection devices may be required to assist a more uniform distribution of the "ice fog" throughout the freeze-dryer. When the freeze-dryer shelves are continually cooled, the time difference between when the first vial freezes and the last vial freezes will create a temperature difference between the vials, which will increase the vial-to-vial non-uniformity in freeze-dried products.

A need has arisen, therefore, for a method that can produce more rapid and uniform freezing of the aqueous solution in all vials in a freeze drying apparatus. The method of the present invention meets this need.

BRIEF SUMMARY OF THE INVENTION

In the new and improved method of the present invention, an ice fog is not formed inside the product chamber by the introduction of a cold gas, e.g., liquid nitrogen chilled gas at −196° C., which utilizes the humidity inside the product chamber to produce the suspension of small ice particles in accordance with known methods in the prior art. These known methods have resulted in increased nucleation time, reduced uniformity of the product in different vials in a freeze drying apparatus, and increased expense and complexity because of the required nitrogen gas chilling apparatus.

My related invention disclosed in pending U.S. patent application Ser. No. 13/097,219 filed on Apr. 29, 2011 utilizes the pressure differential between the product chamber and a condenser chamber to instantly distribute ice nucleation seeding to trigger controlled ice nucleation in the freeze dryer product chamber. The nucleation seeding is generated in the condenser chamber by injecting moisture into the cold condenser. The moisture is injected by releasing vacuum and injecting the moisture into the air entering the condenser. The injected moisture freezes into tiny suspended ice crystals (ice fog) in the condenser chamber. The condenser pressure is close to atmosphere, while the product chamber is at a reduced pressure. With the opening of an isolation valve between the chambers, the nucleation seeding in the condenser is injected into the product chamber within several seconds. The nucleation seeding evenly distributes among the super cooled product triggering controlled ice nucleation.

It has now been determined that during the opening of the isolation valve the sudden change of pressure creates strong gas turbulence in the condenser chamber. This turbulence is capable of knocking off any loosely condensed frost on the condensing surface and breaks it into larger ice crystals. The larger ice crystals break away from the condensing surface and mix in the gas flow rushing into the product chamber. The larger size of the ice crystals enables them to last longer in the product chamber and to make them more effective in the nucleation process.

The larger ice crystals help to achieve consistent nucleation coverage and greatly improve controlled nucleation performance, especially when the product chamber has restriction in gas flow, such as side plates or when the vapor port is located under or above the shelf stack.

Previously the volume of suspended ice fog in gas form was limited by the condenser volume. By adding dense frost on the condensing surface, the physical volume of the condenser is no longer a limitation. The thickness of frost can easily be controlled to achieve a desired density of larger ice crystals in the product chamber during nucleation. The condensed frost method works with any condensing surface. In addition, the size of the condensing chamber may be reduced to increase the velocity of the gas in the condenser.

DETAILED DESCRIPTION OF THE INVENTION

Figure 1:
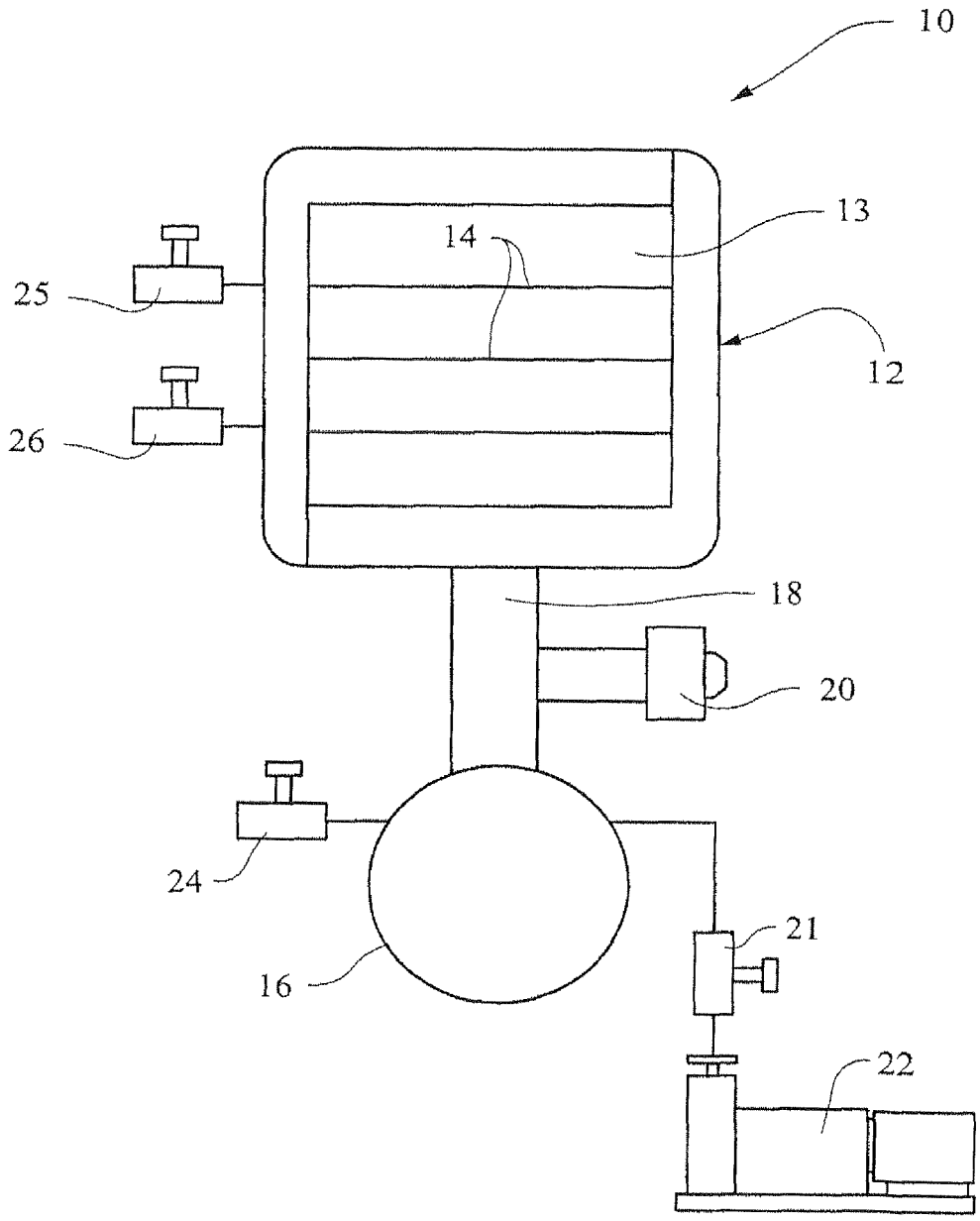
FIG. 1 is a schematic view of one embodiment of apparatus for performing the method of the present invention.

As shown in FIG. 1, an apparatus 10 for performing the method of the present invention comprises a freeze dryer 12 having one or more shelves 14 for supporting vials of product to be freeze dried. A condenser chamber 16 is connected to the freeze dryer 12 by a vapor port 18 having an isolation valve 20 of any suitable construction between the condenser chamber 16 and the freeze dryer 12. Preferably, the isolation valve 20 is constructed to seal vacuum both ways.

A vacuum pump 22 is connected to the condenser chamber 16 with a valve 21 therebetween of any suitable construction. The condenser chamber 16 has a release valve 24 of any suitable construction and the freeze dryer 12 has a control valve 25 and release valve 26 of any suitable construction. As an illustrative example, the operation of the apparatus 10 in accordance with the method of the present invention is as follows:

1. Cool down the shelf or shelves 14 to a pre-selected temperature (for example −5° C.) for nucleation below the freezing point of water enough to super cool the product.
2. Hold the shelf temperature until all of the product probe temperatures are getting very close to the shelf temperature (for example within 0.5° C.).
3. Hold another 10 to 20 minutes for better temperature uniformity across all vials (not shown).
4. With the isolation valve 20 open, open the valve 21 and turn on the vacuum pump 22 to pump down the pressure of the chamber 13 in the freeze dryer 12 and the condenser chamber 16 to a low point which is still above the vapor pressure of water at the product temperature to prevent any bubble formation.(for example 50 Torr)
5. Close the isolation valve 20 between the product chamber 13 and condenser chamber 16, and close the valve 21.
6. Verify condenser temperature is already at its max low usually −53° C. or −85° C.
7. Open the release valve 24 to slowly fill the condenser chamber 16 with moisturized back fill gas up to a predetermined pressure to form a condensed frost of a desired thickness on the inner surface of the condenser chamber.
   a. The actual gas type and moisture added to the condenser chamber 16 can vary depending on user preference such that there is sufficient moisture content to generate the condensed frost, and is within the knowledge of one skilled in the art. As an illustrative example, the gas and moisture content added to the condenser chamber 16 may be nitrogen or argon with a sufficient amount of moisture added.
8. Close the release valve 24 on the condenser chamber 16.
9. Open the isolation valve 20 between the product chamber 13 (at low pressure) and the condenser chamber 16 (at a higher pressure with condensed frost on the inner surface thereof).
   a. The sudden change of pressure creates strong gas turbulence in the condenser chamber which serves to knock off loosely condensed frost on the inner surface thereof and break it into relatively large ice crystals that mix in the gas flow rushing into the product chamber to increase the effectiveness of the nucleation process in the product chamber. The ice crystals are rapidly injected into the product chamber 13 where they are distributed evenly across the chamber and into all of the vials. The ice crystals serve as nucleation sites for the ice crystals to grow in the sub-cooled solution. With the even distribution, all of the vials nucleate within a short period of time. The nucleation process of all vials will start from top down and finish within a few seconds.

Figure 2:
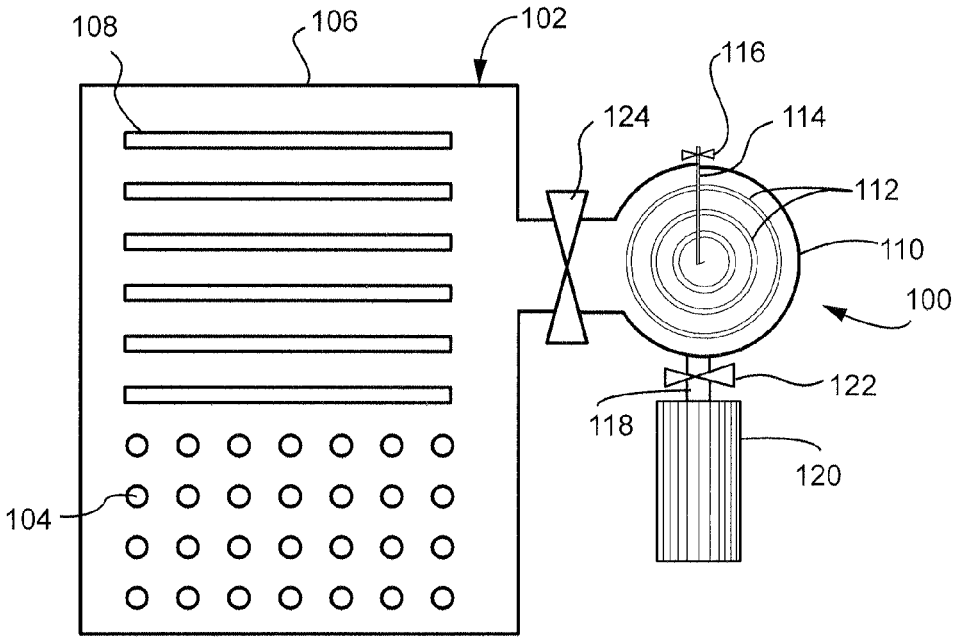
FIG. 2 is a schematic view of a second embodiment of apparatus for performing the method of the present invention connected to a freeze dryer with an internal condenser.

FIG. 2 illustrates a compact condenser 100 connected to a freeze dryer 102 having an internal condenser 104 which is not constructed to produce condensed frost therein and requires an additional seeding chamber and related hardware to be added. The freeze dryer 102 comprises a product chamber 106 with shelves 108 therein for supporting the product to be freeze dried.

The compact condenser 100 comprises a nucleation seeding generation chamber 110 having a cold surface or surfaces 112 defining frost condensing surfaces. The cold surface 112 may be a coil, plate, wall or any suitable shape to provide a large amount of frost condensing surface in the nucleation seeding generation chamber 110 of the compact condenser 100. A moisture injection nozzle 114 extends into the nucleation seeding generation chamber 110 and is provided with a moisture injection valve 116. A gas supply line 118 having a filter 120 is connected to the nucleation seeding generation chamber 110 by vacuum release valve 122. The nucleation seeding generation chamber 110 of the compact condenser 100 is connected to the freeze dryer 102 by a nucleation valve 124.

In operation, the flow of gas and moisture into the nucleation seeding generation chamber 110 produces condensed frost on the surfaces of the concentric walls 112. Since the pressure in the compact condenser 100 is greater than that in the freeze dryer 102, when the nucleation valve 124 is opened, strong gas turbulence is created in the nucleation seeding generation chamber 110 to remove loosely condensed frost on the inner surfaces of the walls 112 therein and to break it into ice crystals that mix in the gas flow rushing into the product chamber 106 to increase the effectiveness of the nucleation process in the product chamber.

Figure 3:
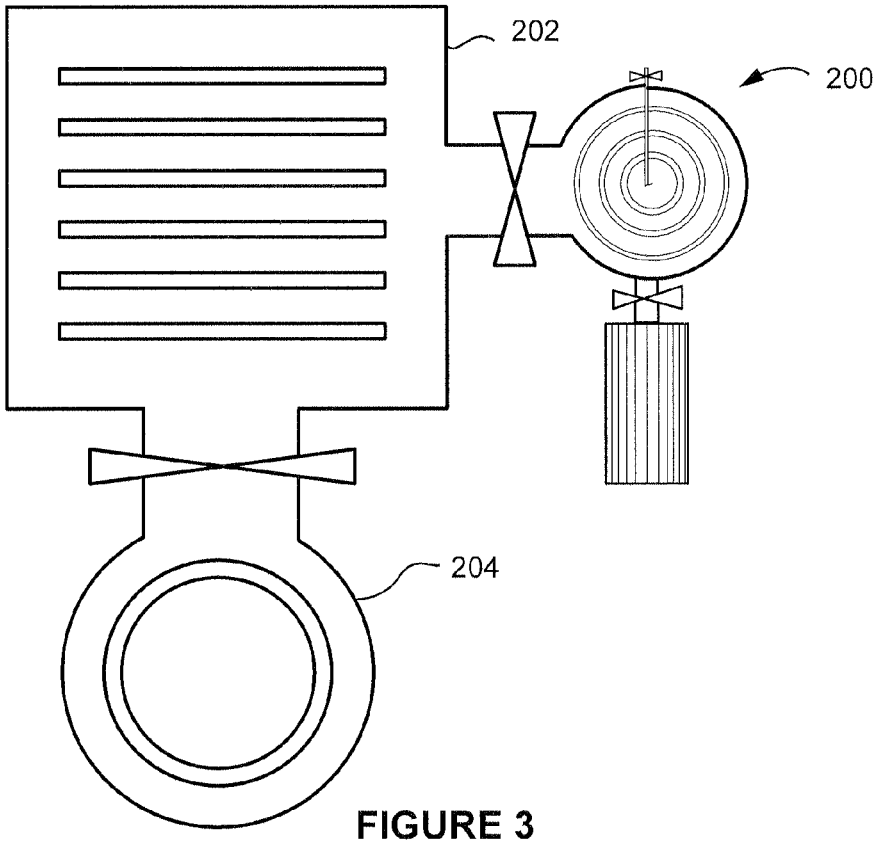
FIG. 3 is a schematic view of the second embodiment of the apparatus for performing the method of the present invention connected to a freeze dryer having an external condenser.

FIG. 3 illustrates a compact condenser 200 connected to a freeze dryer 202 having an external condenser 204. The construction and operation of the compact condenser 200 is the same as that of the compact condenser 100 shown in FIG. 2.

This method of nucleation is unique by combining an external controllable pre-formation of condensed frost with a sudden pressure differential distribution method. This results in a rapid nucleation event because of the large ice crystals, taking seconds instead of minutes, no matter what size of system it is used on. It gives the user precise control of the time and temperature of nucleation and has the following additional advantages:

1. Pre-formation of condensed frost in the external condenser chamber is controllable to allow the formation of the ice crystals to be easily controlled.
2. The pressure differential ratio can also be controlled to optimize the distribution of ice crystals uniformly across all vials within a few seconds.
3. No local or batch wise temperature change to the product before the actual nucleation allows for precise control of nucleation temperature.
4. The product chamber will remain in a negative pressure, even after introduction of the ice crystals. There is no danger of creating a positive pressure.

5. This method can be used on any size freeze dryer with an external condenser and an isolation valve without any system modification. Other methods require significant modification or cost.
6. This method can guarantee the sealed sterile operation mode for pharmaceutical production environment application.
7. The advantage of a uniform nucleation method for the application of freeze drying is a uniform crystal structure and large aligned crystals across all of the vials, thus enabling a reduced primary drying process.
8. The formation of condensed frost on the inner surface of the condenser chamber enables a smaller condenser chamber with a high condensing surface area to be used and added to any freeze dryer. The condensed frost takes up less volume than a suspended ice fog.
9. Compared to the gas form of suspended ice fog, which must be generated just before the trigger of nucleation, the condensed frost is more stable and can be stored for an extended period of time and used on demand.
10. The frost formation environment can be carefully controlled to generate a loosely condensed frost which breaks down into ice crystals by gas turbulence during pressure release by use of a high condenser chamber pressure (e.g., 500 Torr a high volume low velocity gas flow and a warmer condensing surface temperature (e.g., below 0 degrees C.).
11. The larger ice crystals from the condensed frost are denser and stay frozen longer than the gas form of ice fog during the introduction into the product chamber to expedite the nucleation process.
12. A more compact condenser can be added to systems that don't have an external condenser or where the existing condenser does not enable building condensed frost, or the existing condenser can't be validated for sterility.

From the foregoing description, it will be readily seen that the novel method of the present invention produces a condensed frost in a condenser chamber external to the product chamber in a freeze dryer and then, as a result of gas turbulence, rapidly introduces ice crystals into the product chamber which is at a pressure much lower than the pressure in the condenser chamber. This method produces rapid and uniform nucleation of the product in different vials of the freeze dryer.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of controlling and enhancing the nucleation of product in a freeze dryer, comprising:

maintaining the product at a predetermined temperature and pressure in a chamber of the freeze dryer;

creating a predetermined volume of condensed frost on an inner surface of a condenser chamber separate from the product chamber and connected thereto by a vapor port, the condenser chamber having a predetermined pressure that is greater than that of the product chamber; and opening the vapor port into the product chamber to create gas turbulence that breaks down the condensed frost into ice crystals that rapidly enter the product chamber for even distribution therein to create uniform and rapid nucleation of the product in different areas of the product chamber.

2. The method of claim 1 wherein the vapor port has an isolation valve between the product chamber and the condenser chamber to open or close vapor flow therebetween.

3. The method of claim 1 wherein a vacuum pump is connected to the condenser chamber for selectively reducing the pressure within the product chamber and the condenser chamber when the isolation valve is opened.

4. The method of claim 1 wherein the pressure within the product chamber is about 50 Torr and the pressure within the condenser chamber is about atmospheric when the vapor port is opened into the product chamber.

5. The method of claim 4 wherein the temperature of the product is about −5.0° C. and the temperature of the condenser chamber is less than 0° C. when the vapor port is opened into the product chamber.

6. The method of claim 1 wherein a predetermined moisturized back fill gas is introduced into the condenser chamber to produce the condensed frost.

7. The method of claim 6 wherein the condenser chamber has a release valve which is opened to enable the moisturized back fill gas to be introduced into the condenser chamber to produce the condensed frost.

8. The method of claim 6 wherein the back fill gas is filtered ambient atmospheric air and has a moisture content of about 50-80% by volume.

9. The method of claim 6 wherein the back fill gas is nitrogen or argon with moisture added thereto.

10. The method of claim 1 wherein the inner surface of the condenser chamber is defined by a plurality of inner walls.

11. The method of claim 10 wherein the inner walls are in a coil configuration to maximize the size of the inner surface.

* * * * *